US005205203A

United States Patent [19]

Rossato

[11] Patent Number: 5,205,203

[45] Date of Patent: Apr. 27, 1993

[54] HYDRAULIC CYLINDER-PISTON UNIT PROVIDED WITH A MECHANICAL SAFETY DEVICE, PARTICULARLY FOR PANTOGRAPH TYPE MOTOR VEHICLE LIFTS

[76] Inventor: Eride Rossato, Via Mazzini, 7, I-30035, Ballo di Mirano, Italy

[21] Appl. No.: 418,681

[22] Filed: Jun. 8, 1989

Related U.S. Application Data

[63] Continuation of Ser. No. 110,722, filed as PCT/EP86/00696 on Dec. 2, 1986, abandoned.

[30] Foreign Application Priority Data

Dec. 5, 1985 [IT] Italy ..... 84159 A/85

[51] Int. Cl.[5] ..... F15B 15/26

[52] U.S. Cl. ..... 92/19; 92/24; 92/27

[58] Field of Search ..... 92/14, 15, 18, 19, 23, 92/24, 27, 28

[56] References Cited

U.S. PATENT DOCUMENTS

| | | | |
|---|---|---|---|
| Re. 25,334 | 2/1963 | Michalak, Jr. . | |
| 2,540,578 | 2/1951 | Hall et al. | 92/19 |
| 2,808,810 | 10/1957 | Lindley | 92/52 |
| 2,811,951 | 11/1957 | Bodem et al. | 92/28 X |
| 3,008,454 | 11/1961 | Wilkins | 92/24 X |
| 3,020,888 | 2/1962 | Braun | 121/40 |
| 3,104,593 | 9/1963 | Clifton et al. | 92/17 |
| 3,342,111 | 9/1967 | Royster | 92/24 |
| 3,578,783 | 5/1971 | Loustalet et al. | 92/15 X |
| 3,831,901 | 8/1974 | Williams et al. | 92/15 X |
| 4,754,694 | 7/1988 | Martin | 92/14 X |

FOREIGN PATENT DOCUMENTS

| | | |
|---|---|---|
| 211847 | 3/1908 | Fed. Rep. of Germany . |
| 952142 | 11/1949 | France . |
| 211412 | 2/1924 | United Kingdom . |
| 490886 | 8/1938 | United Kingdom . |
| 1008080 | 10/1965 | United Kingdom . |

*Primary Examiner*—Edward K. Look
*Attorney, Agent, or Firm*—Hoffman, Wasson & Gliter

[57] ABSTRACT

A hydraulic jack particularly intended for use in automobile lifts includes a safety stop mechanism including a fixed toothed rod and a piston-supported pawl mechanism which includes one or more stop members. Each of the stop members can be retracted, to allow the jack to collapse, by applying hydraulic pressure to the chamber above the piston.

5 Claims, 2 Drawing Sheets

HYDRAULIC CYLINDER-PISTON UNIT PROVIDED WITH A MECHANICAL SAFETY DEVICE, PARTICULARLY FOR PANTOGRAPH TYPE MOTOR VEHICLE LIFTS

This is a continuation of copending application Ser. No. 110,722, filed as PCT/EP86/00696 on Dec. 2, 1986, now abandoned.

This invention relates to a hydraulic cylinder-piston unit provided with a mechanical safety device, particularly for motor vehicle lifts of the pantograph type.

Motor vehicle lifts of the pantograph type are known. They generally comprises a pair of runways and cylinder-piston units which raise said runways, on which the vehicle to be lifted has been previously positioned.

Current accident-prevention regulations require the provision of mechanical safety systems to ensure that the level attained by the runways is maintained, even if the pressure of the hydraulic circuit feeding the cylinder-pistons units accidentally falls.

Known safety systems generally consist of racks engaged by pawl assemblies which allow the racks to move freely relative to them during the raising of the lift, but prevent their opposite movement, thus ensuring stability of the attained configuration.

To lower the lift it is necessary firstly to disengage the pawl assemblies from the corresponding rack, and then discharge the operating fluid from the cylinder-piston units.

Known mechanical safety systems for application to hydraulic cylinder-piston units, in particular for operating lifts of the pantograph type, have certain drawbacks, and in particular:

their installation is somewhat complicated because it involves additional work beyond that required for installing the cylinder-piston units, they are somewhat bulky, this being often difficult to reconcile with the limited space available, they require a self-contained system or circuit for deactivating them during the lowering of the lift.

Safety systems have also been proposed (see for example in U.S. Pat. No. 4,251,056; FR-A- 2.376.062; U.S. Pat. No. 2,998,224; GB-A-211.412; GB-A- 490.886) which integrate the rack in the stem of the piston so as to reduce the workings due to the installation of the cylinder-piston unit, and the whole encumbrance of the system.

Nevertheless these solutions had not succeeded to eliminate other considerable drawbacks, and in particular:

the impossibility to realize double-acting systems, in that the presence of the notches in the stem of the piston does not allow this to have a good seal with respect to the head through which the stem protrudes.

an easy entry of the dust and dirt through the passage opening for the stem which causes unavoidable rifting with the passing of the time, of the inner surface of the cylinder and the quick deterioration of it, a laboriousness of the workings for the disengagement of the safety device, which must be disengaged manually or by a separate control circuit.

An object of the invention is to obviate these drawbacks by providing a double-acting hydraulic cylinder-piston unit with an associated mechanical safety device which is without bulk and requires no special additional installation work.

A further object of the invention is to provide a hydraulic cylinder-piston unit with an associated mechanical safety device which for disengaging this latter uses the actual hydraulic feed circuit of the cylinder-piston unit.

These and further objects which will be apparent from the description given hereinafter are attained according to the invention by a hydraulic cylinder-piston unit provided with a mechanical safety device, comprising a cylinder in which there slides a piston provided with a rod emerging from an endpiece of said cylinder, characterized by comprising inside the cylinder a portion provided with toothing extending along the axis of said cylinder and cooperating with at least one deactivatable stop member which during the elongation stage of said cylinder-piston unit moves relative to said toothed portion by yielding elastically in its passage from one tooth to the next, whereas during the retraction stage it engages in the facing notch defined by two successive teeth, to thus form the mechanical safety stop.

Advantageously, the cylinder of the hydraulic cylinder-piston unit according to the invention can be formed with one endpiece closed and the other endpiece comprising a hole for the oil-tight passage of the piston rod, this rod being hollow and housing in its interior a second rod which is fixed at one end to the closed endpiece of said cylinder, is mobile axially relative to said hollow rod by means of said piston, and is provided with a toothed portion cooperating with a pawl assembly rigid with said hollow rod.

Again according to the invention, the piston can comprise radial recesses opening into the piston bore for said second rod, in order to guide stop blocks which are kept elastically adhering to the lateral surface of said second rod and are provided with means for causing them to retract into the body of the piston.

Further according to the invention, the stop pawl assembly for the toothed rod can be provided with a sensor which detects its deactivated state.

A preferred embodiment of the present invention is described hereinafter by way of non-limiting example with reference to the accompanying drawings in which.

Figure 1:
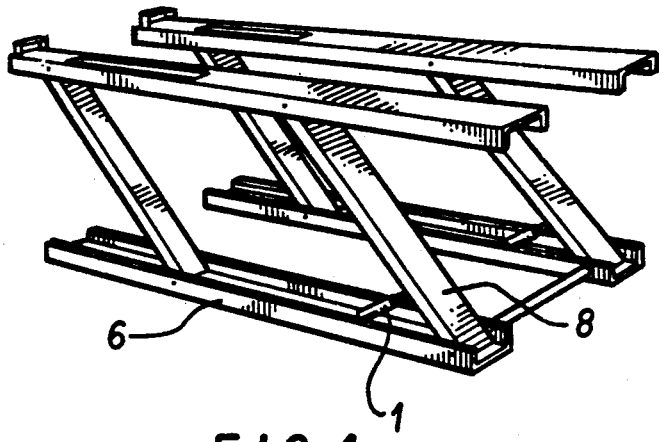
FIG. 1 is a perspective diagrammatic view of a lift of the pantograph type provided with hydraulic cylinder-piston units according to the invention.

As can be seen from the figures, the hydraulic cylinder-piston unit according to the invention comprises a cylinder 1 closed lowerly by a solid endpiece 2, and closed upperly by an endpiece 3 comprising a central circular hole for the oil-tight passage of a rod 4.

When used in a lift (see FIG. 1), the endpiece 2 is provided with a lug for its connection and hinging to a lower longitudinal member 6 of the lift, and the outer end of the rod 4 is provided with a head 5 for its connection and hinging to an upright 8.

Figure 2:
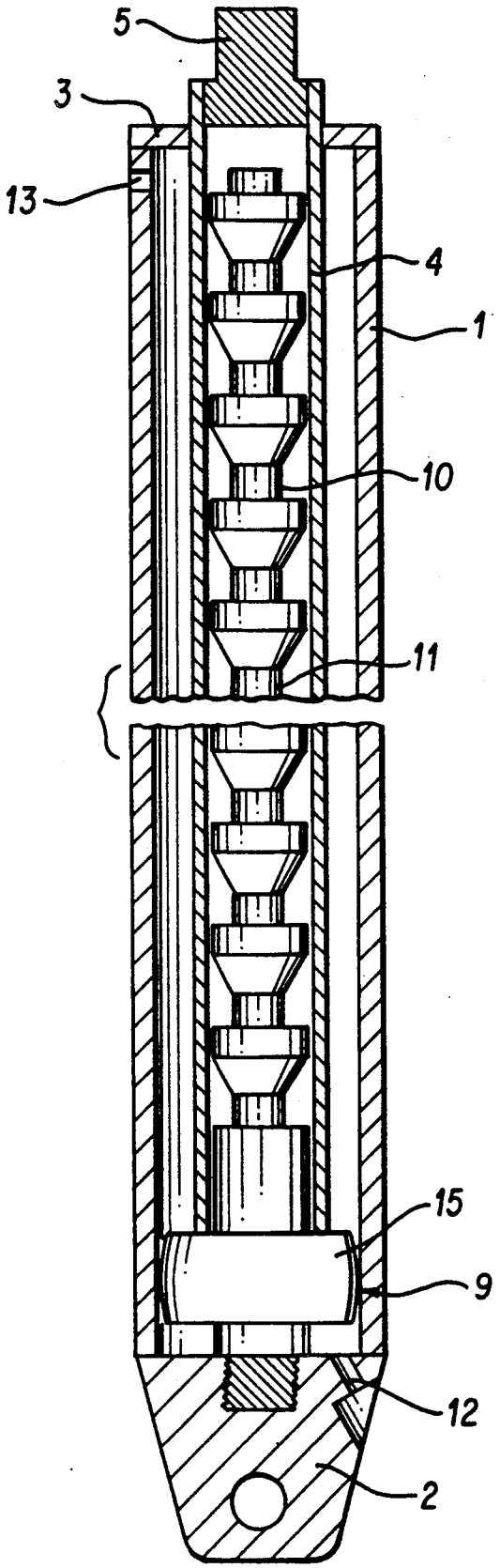
FIG. 2 is an axial section through a cylinder-piston unit to an enlarged scale.

The rod 4, which is hollow, is connected to a piston 9 slidable in an oil-tight manner inside the cylinder 1. In the interior of the rod 4 there is housed a further rod 10, which comprises a plurality of equidistant circumferential notches 11 having a sawtooth profile, as can be seen from FIG. 2. The rod 10 is mobile axially relative to the rod 4, and is fixed at one end to the endpiece 2 of the cylinder 1. The rod 10 also traverses the piston 9, without any need for sealing.

In the endpiece 2 there is provided an aperture 12 for the passage of oil into and from the cylinder 1, and an aperture 13 is provided in the lateral surface of the cylinder 1 in proximity to the endpiece 3.

The piston 9 consists substantially of a pair of annular flanges indicated overall by 14 and 14', and joined together by screws.

These flanges have an outer profile which is complementary to the profile of a rubber gasket 15 which seals the piston 9 against the inner lateral surface of the cylinder 1.

The upper flange 14, which is screwed to the rod 4, comprises three radial recesses 16 disposed at 120° apart, in which stop blocks 17 can slide.

Figure 3:
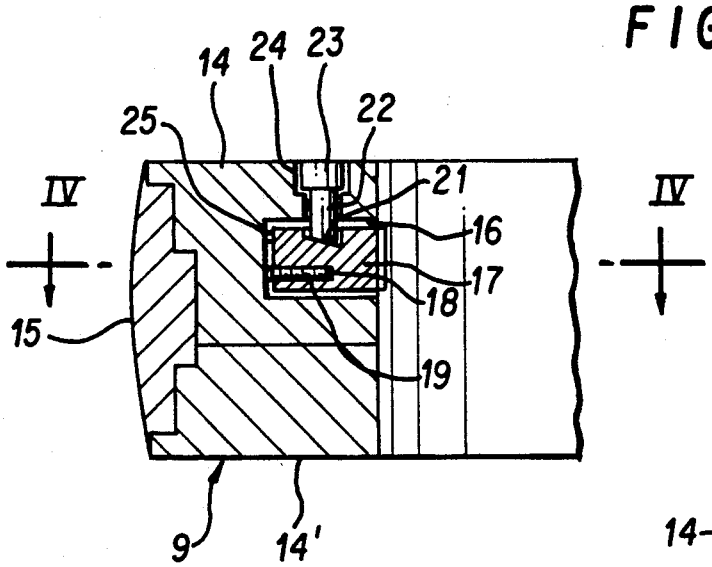
FIG. 3 is a partial longitudinal section through the piston of the cylinder-piston unit to an enlarged scale.
Figure 4:
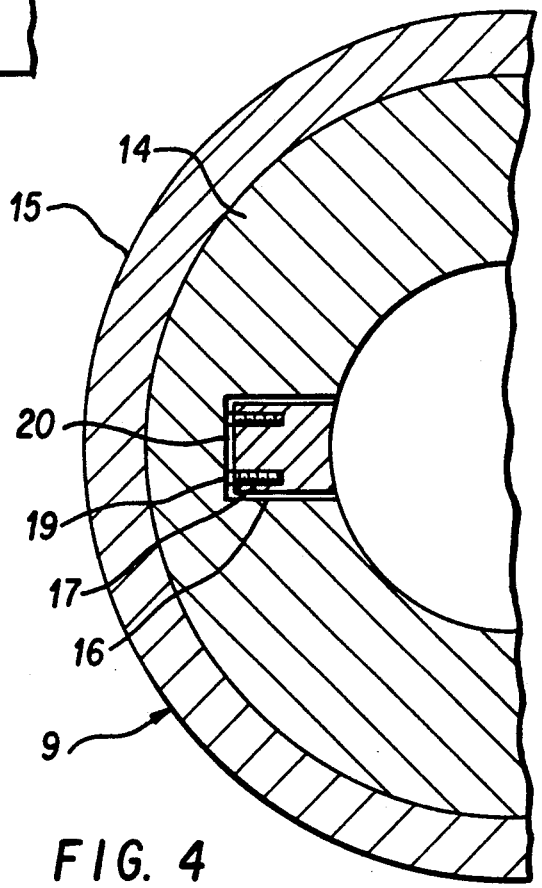
FIG. 4 is a section therethrough on the line IV—IV of FIG. 3.

More specifically, each stop block 17 has its front profile curved to correspond to the facing surface of the toothed rod 10, and comprises two cylindrical cavities 18 for housing small helical springs 19 interposed between said block 17 and the shoulder 20 which delimits the rear of the corresponding recess 16. It also comprises an inner cavity having an inclined surface 21 facing upwards in FIG. 3. On said inclined surface there rests the eccentric stem 22 of a plunger 23 mobile axially in a sealed manner within a corresponding cylindrical cavity 24 formed in the upper flange 14 and communicating with the interior of the cylinder 1.

As there exists a cylindrical cavity 24 for each of the three blocks 17 and as the guide recesses 16 for these latter are disposed at 120° apart, the three cylindrical cavities 24 are also disposed at 120° apart.

The operation of the hydraulic cylinder-piston unit according to the invention is as follows: when in the rest state (minimum elongation) the piston 9 is in its lower end-of-stroke position, that cylindrical portion of the rod 10 not provided with toothing faces the three blocks 17, the three blocks 17 are urged by the respective springs 19 to adhere to the cylindrical surface of the rod 10, and the plungers 23 are raised. The piston 9, which is in its lowered position, divides the inner bore of the cylinder 1 into two regions: namely the lower region connected to the inlet aperture 12, and comprising the annular cavity defined by the piston 9 and lower endpiece 2 and also extending into the space defined by the rods 4 and 10; and the upper region connected to the outlet aperture 13, and comprising the annular cavity defined vertically by the piston 9 and the upper endpiece 3. Under these conditions the two regions are at the same pressure.

In order to raise the lift, oil is fed under pressure into the cylinder 1 through the aperture 12. This feed causes the piston 9 to rise, and the cylinder-piston unit to undergo corresponding elongation.

As the piston 9 withdraws from the lower endpiece 3, the rod 10, which is fixed to this latter, withdraws from the rod 4 and thus its lateral surfaces slides over the end of the three stop blocks 17, which are biased radially inward.

As oil feed into the cylinder 1 continues, there is a progressive withdrawal of the rod 10 from the rod 4, with successive intervention of the stop blocks 17, which because of the sawtooth profile of the circumferential notches 11 retract into the body of the flange 14 as they pass between one notch and the next, and elastically emerge in a snapwise manner each time a notch appears in front of them.

It is apparent that when they are in their emerged state they constitute a mechanical safety stop which prevents the rod 4 from retracting into the cylinder 1, even if the pressure of the feed circuit should accidentally fall.

When this elongation of the cylinder-piston unit is complete, the feed of oil is suspended and a small amount of this latter is allowed to escape through the aperture 12, in order to ensure the mechanical engagement of the blocks 17 in the corresponding notch 11.

In order to lower the lift and thus cause each rod 4 to retract into the respective cylinder 1, the cylinder-piston units are firstly made to elongate slightly by normal methods in order to disengage the stop blocks 17 from the relative notch 11. Oil is then fed through the aperture 13. Its pressure acts initially on the plungers 23, which descend and press by way of their stem 22 against the inclined surface 21 of the corresponding stop blocks 17. By virtue of this, the blocks 17 are withdrawn into the piston 9 along the respective recesses 16, so that they no longer interfere with the toothed rod 10. By continuously feeding oil through the aperture 13 with simultaneous discharge of other oil through the aperture 12, the piston 9 is made to descend, with the toothed rod 10, which is no longer hindered by the stop blocks 17, simultaneously retracting into the rod 4.

The retraction of the stop blocks 17 into the piston 9 is opposed by the elastic reaction of the springs 19, and consequently, when the overpressure in the upper chamber of the cylinder 1 ceases, this reaction prevails and urges the blocks 17 into their engaged state and, by virtue of the interaction between each stem 22 and the inclined surface 21 of the relative block 17, causes the release plungers 23 to rise and to return to their rest configuration.

From the aforegoing it is apparent that the hydraulic cylinder-piston unit according to the invention has numerous advantages over conventional cylinder-piston units provided with an external mechanical safety device, in that:

it involves practically no substantial size increase deriving from the mechanical safety device, it enables the mechanical safety device to be installed without requiring any work additional to that required for installing the cylinder-piston unit, it requires no independent device or circuit for releasing the mechanical safety device before the retraction of the rod into the cylinder is commenced, it provides a high guarantee of correct operation and long life, in that all the moving parts operate immersed in oil.

The cylinder-piston unit according to the invention is used advantageously in pantograph lifts of the type shown diagrammatically in FIG. 1. In this application, if the lift has no direct transverse connections between the runways, it is preferable to be able to check that the stop blocks are effectively in their disengaged stage before lowering the lift, so as to prevent any possible dangerous consequences deriving from unbalanced loads. For this purpose, between the rear shoulder 20 of at least one radial recess 16 and the corresponding stop block 17 of each cylinder-piston unit there is provided a member, such as a microswitch 25, which enables the lift to be lowered only if activated by the block when in its rear end-of-travel position.

I claim:

1. A hydraulic cylinder-piston unit having a mechanical safety device, particularly for motor vehicle lifts of the pantograph type, comprising a cylinder having a first, close, endpiece at one end thereof and a second endpiece at the opposite end thereof, said second endpiece having an aperture therein, a piston slidably contained within said cylinder and dividing the same into a rod end chamber and a closed end chamber, a hollow rod attached to said piston and extending through the aperture of said second endpiece, a toothed rod fixed at one end of said cylinder to the closed endpiece thereof, said hollow rod being axially movable with respect to said toothed rod by means of said piston, said piston containing a pawl assembly cooperating with said toothed rod, said pawl assembly comprising at least one radially movable stop member and means for biasing said stop member toward said toothed rod, whereby during elongation of the cylinder-piston unit the stop member yields elastically in passing from one tooth to the next, whereas during retraction of the unit said stop member engages within a notch defined between two successive teeth, thereby forming a mechanical safety stop, and further comprising, for each stop member, a plunger mounted in said piston for movement parallel to the axis thereof and having an upper surface exposed to the rod end chamber of the cylinder and said plunger further comprising means for retracting the respective stop member into the piston and out of engagement with the toothed rod.

2. The invention of claim 1, wherein the plunger is provided with a stem cooperating with an inclined surface provided on the stop member, whereby axial movement of the plunger causes said stop member to withdraw into the piston.

3. The invention of claim 1, wherein each stop member is provided with a sensor for detecting its deactivated state.

4. The invention of claim 3, further comprising a sensor which detects when each stop member has reached its end-of-travel position in a corresponding guide recess provided in the piston.

5. The invention of claim 4, wherein the sensor comprises a microswitch activated by the relative stop member when the latter reaches its rear end-of-travel position.

* * * * *